US006058608A

United States Patent [19]

Wruck

[11] Patent Number: 6,058,608

[45] Date of Patent: May 9, 2000

[54] LINE TRIMMER

[76] Inventor: Rickey A. Wruck, 32902 County Rd. 50, Stearns, Minn. 56310

[21] Appl. No.: 09/143,009

[22] Filed: Aug. 28, 1998

[51] Int. Cl.[7] ..... B26B 29/00

[52] U.S. Cl. ..... 30/289; 30/286

[58] Field of Search ..... 30/30, 32, 34.05, 30/77, 286, 287, 289, 294; D28/45

[56] References Cited

U.S. PATENT DOCUMENTS

| | | | |
|---|---|---|---|
| 1,486,672 | 3/1924 | Mazzoni . | |
| 1,541,624 | 6/1925 | Chute | 30/30 |
| 1,667,462 | 4/1928 | Logan . | |
| 1,976,290 | 10/1934 | Motley . | |
| 2,530,917 | 11/1950 | Taylor | 30/30 |
| 2,544,479 | 3/1951 | Zengel . | |
| 2,641,055 | 6/1953 | Mansfield . | |
| 2,814,865 | 12/1957 | Sunich | 30/30 |
| 2,972,187 | 2/1961 | Gore . | |
| 3,675,325 | 7/1972 | Michelson . | |
| 3,774,294 | 11/1973 | Michelson . | |
| 4,037,322 | 7/1977 | Bresler | 30/30 |
| 4,211,006 | 7/1980 | Halaby et al. . | |
| 4,441,252 | 4/1984 | Caves . | |
| 4,663,841 | 5/1987 | Custer . | |
| 4,769,913 | 9/1988 | Kuramochi . | |
| 5,182,874 | 2/1993 | Powell . | |
| 5,359,776 | 11/1994 | Glazar . | |
| 5,685,037 | 11/1997 | Fitzner et al. . | |

*Primary Examiner*—Hwei-Siu Payer
*Attorney, Agent, or Firm*—Albert W. Watkins

[57] ABSTRACT

The present invention encapsulates a razor blade in a relatively thick and durable plastic. In the plastic there are provided a number of comb-like projections which extend beyond the blade edge while still leaving the edge exposed between the protrusions. These protrusions serve to guard the blade from accidental contact, thereby enabling the present invention to be safely carried, even in a person's trouser pocket. Other features are molded into the plastic at the time of manufacture which allow the invention to be hooked onto a key ring and which further enable line of indeterminate length to be wrapped longitudinally about the invention. Due to low cost of manufacture, the present invention may be disposed of when the blade dulls. The plastic serves as a protective guard even after disposal, offering environmental resistance comparable to that of the blade. When the plastic degrades sufficiently to crack and separate from the blade, the blade will similarly have degraded and the edge dulled sufficiently to present substantially less hazard.

19 Claims, 1 Drawing Sheet

LINE TRIMMER

BACKGROUND OF THE INVENTION

1. Field of the Invention

This invention pertains to razor type cutting devices generally, and more specifically to a line trimmer having a razor integrally and permanently molded into a safely transportable housing.

2. Description of the Related Art

The cutlery art is an old and highly refined field, having origins that date to man's earliest tools. Hammered rock edges, sharp fragments of bone or tooth, tusks and other easily derived devices provided humans with the earliest cutlery. These naturally occurring or minimally refined knife blades were replaced with copper and iron blades as people began to develop the art of metal working. Metal blades offered distinct advantages, delivering thinner, sharper and often more durable cutting edges.

As with many other inventions, metal blades brought new challenges to the world. These cutting edges were so sharp that they were able to almost effortlessly cut human flesh. The problem was compounded with the development of razor blade technology at the start of the twentieth century, when paper-thin metal was formed into cutting edges. As any office worker can attest to, paper itself is capable of cutting flesh when mishandled. These new razor blades were so sharp that simple contact with the edge would break through one's skin.

Nevertheless, the world had many applications for these newer and sharper blades. Among the earlier applications are hair trimmers, which often included combs clamped about razor blades. These trimmers were designed to be drawn through a person's hair. As long as the blade remains sharp, the hair is severed upon contact with the blade. Exemplary of these are U.S. Pat. No. 1,486,672 to Mazzoni; U.S. Pat. No. 1,976,290 to Motley; U.S. Pat. No. 2,972,187 to Gore; and U.S. Pat. No. 4,441,252 to Caves. Each of these patents disclose hair trimmers having a blade clamped between removable, combed housing pieces, and having handles extending therefrom. U.S. Pat. No. 2,641,055 to Mansfield and U.S. Pat. No. 4,663,841 to Custer each disclose similar hair trimmers, without the handle. Other applications include fuzz removers, as shown in U.S. Pat. No. 4,769,913 to Kuramochi; finger nail trimmers as shown in U.S. Pat. No. 2,544,479 to Zengel; fishing line trimmers such as U.S. Pat. No. 5,182,874 to Powell and U.S. Pat. No. 5,685,037 to Fitzner et al; and even windshield wiper blade sharpening devices such as U.S. Pat. No. 5,359,776 to Glazar. Each of these foregoing designs provide a razor edge while, to varying degree, protecting a person from injury.

Other attempts were made to protect a person from unintentional injury, while still allowing these blades to be used for diverse purposes. Logan illustrates this in his combination tool disclosed in U.S. Pat. No. 1,667,462. The Logan tool includes a folding blade and holder, which allows the blade to be exposed during use and otherwise safely stored. In addition, Logan identifies the possible utility of the new blades for applications as diverse as thread or twine cutting, shaving, cigar cutting, seam ripping, pencil sharpening, furrier and leather cutting, newspaper clipping, and even corn cutting.

In parallel to these diverse applications has been the further development of the razor blade for the original use of shaving hair from the skin. As with other applications, skin cuts are undesirable. Various attempts have been made to allow the blade to still operate effectively while reducing the chances of damaging skin. Examples are found in U.S. Pat. No. 3,675,325 and U.S. Pat. No. 3,774,294 to Michelson and U.S. Pat. No. 4,211,006 to Halaby et al, which each provide small rounded protrusions extending from the blade edge to assist in guiding the blade over skin without cutting in.

In addition to protection during use, there is a need for safe blade disposal. Since razor blades are designed for use in a wet, soapy environment, and yet are still expected to remain sharp for extended periods, the materials have been designed to be highly resistant to environmental degradation. Furthermore, they are designed for nearly effortless cutting. How then does one dispose of used blades, when they do not degrade quickly and can cut through large quantities of trash or protective wrapping to once again expose persons to injury?

In spite of the many years razor blades have been available, there has not yet been a razor cutter that could truly offer the full benefit of the sharp blade and small size while still protecting a person from accidental injury and enabling safe disposal. To the contrary, the vast majority of these devices were unsuccessful specifically because of the damage they would cause to an unwary user either during use or after disposal. For example, hair trimmers include provisions for removing the razor blade from trimmer. Unfortunately, these trimmers occasionally loosen during use, exposing the person to the blade and potential injury. In many cases then, a compromise is made between the size of the guard and the ability for the blade to perform an intended function.

Nowhere is this more obvious than with razors designed for shaving, such as in the Michelson patents referenced hereinabove, where guards are only a few thousandths of an inch thick. In fact, and in spite of these guards, because of the risk of injury and difficult disposal, a large market has developed for electric razors.

The same is true, of course, for each of the other applications, where alternative devices have been used to avoid the risk of injury from the razor. In sewing, scissors are vastly preferred and steel seam rippers have also gained wide-spread use, in spite of the improved cutting ability and lower cost of the razor. Noteworthy is the fact that a razor often costs significantly less than a single scissor resharpening, and the razor provides improved cutting ability. In fishing, nail clippers are a common part of the tackle instead of razor blades. This is striking when one contemplates the frequent injuries that result from fish hooks. Fishermen are more concerned about razors than fish hooks.

As is apparent, the razor has not established dominance proportional to it's effectiveness among cutlery. Primary among the factors contributing to this lack of success is the enormous risk of injury during use, when changing blades, and after disposal.

SUMMARY OF THE INVENTION

In a first manifestation of the invention, a line trimmer comprises a razor blade having a planar surface and a sharp edge; a single contiguous body molded about the razor blade; means within the molded body for guiding line into the sharp edge; and means within the molded body extending from beyond the sharp edge inward along the planar surface, to expose the edge and a small part of the blade's planar surface for preventing manual contact with the edge under application of manual force.

In a second manifestation of the invention, a molded plastic cutter comprises a sharp, double-edged razor blade having a length, width, and thickness, where the thickness is substantially less than length or width and where the sharp double edges each extend along the length on opposite sides of the blade; a plastic body enveloping the razor blade and preventing manual contact therewith; two grooves formed in the body adjacent the razor width and at opposite ends thereof, a first hole adjacent one groove but bridged therebetween by a small bridge of plastic; a second hole extending through the razor and body in a central portion of a first surface bounded by length and width; a third hole extending through the razor and body in a central portion of the first surface, but displaced from the second hole; openings in the body along the length which expose razor edges intermittently, through which objects may be inserted for cutting.

OBJECTS OF THE INVENTION

A first object of the invention is to provide a guarded cutlery tool which may be handled ruggedly and even carelessly without fear of injury or accident. A second object is to provide a cutlery tool offering many of the benefits of thin, sharp razor blades. A further object of the invention is to provide a low cost, disposable cutlery tool. Another object is to ensure safe disposal of the cutlery tool. Yet another object is to enable convenient storage of the tool on key chains and the like. A further object is to provide storage of indeterminate length line about the tool for quick and easy dispensing, to user-selected lengths. These and other objects of the invention are accomplished in the preferred embodiment, which will be best understood when considered in conjunction with the attached drawing figures.

DESCRIPTION OF THE PREFERRED EMBODIMENT

Figure 1:
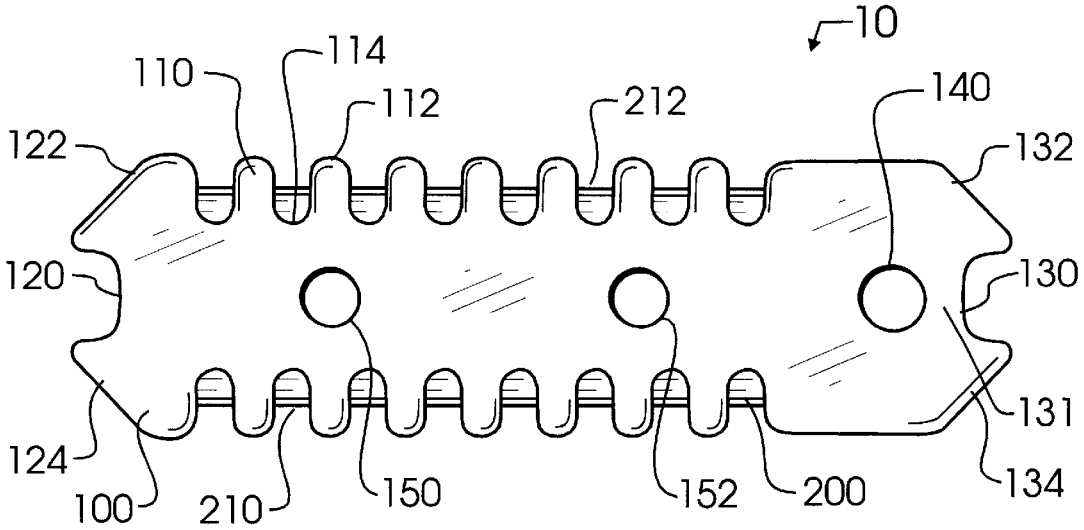
FIG. 1 illustrates the preferred embodiment line trimmer constructed in accordance with the invention from a top view.

The preferred embodiment line trimmer 10 includes a plastic body 100 formed about razor blade 200. Blade 200, in the preferred embodiment, includes two blade edges 210, 212. By using double-edged blade 200, manufacturing is simplified. Blade 200 may be positioned through molding locator holes 150, 152 relative to a mold housing, thereby ensuring repeatable location of blade 200 relative to body 100. In addition, two cutting edges are accessible in a single trimmer, thereby allowing longer use. In addition, no special manipulation or flipping of trimmer 10 will be required to position a blade edge for cutting, since either long surface of body 100 includes one of blade edges 210, 212.

Figure 2:
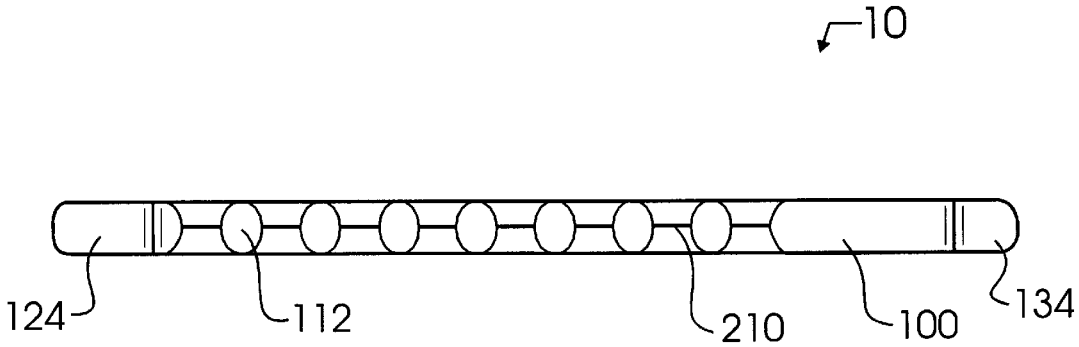
FIG. 2 illustrates the preferred embodiment of FIG. 1 from a side view.

Into body 100 there is formed a guard comprising a number of slightly rounded protruding ends 112 and rounded bases 114. Protruding ends 112 extend significantly beyond blade edges 210, 212 and are also spaced sufficiently close together to ensure no contact will be made by a person including a child, with edges 210, 212, even when large manual forces are applied between the person and trimmer 10. As is best visible in FIG. 2, body 100 is substantially thicker than blade 200, so that regardless of the angle of pressure, there will be no body contact with blade 200. In the preferred embodiment, there is at least one-sixteenth of an inch of plastic body 100 protruding in each axis beyond blade 200. There is one-quarter of an inch spacing between each protruding end 112, and each protruding end 112 extends approximately three-sixteenths of an inch from each rounded base 114.

Because body 100 is molded, a number of additional features are provided without adding any significant cost to trimmer 10. Line wrapping grooves 120 and 130 are provided, which enables a user to wrap line, string, thread or other similar material of indeterminate length about trimmer 10. The line is then available for use on-demand, and trimmer 10 may be used to cut the line to any particular desired length. Each groove 120, 130 includes tapered corners 122, 124 and 132, 134 respectively. These tapered corners offer enhanced protection for the blade at corner stress points, and in addition offer a better aesthetic appearance and more comfortable grip. Key ring hole 140 may also be provided, to allow the user to store trimmer 10 on a key ring, lanyard or other retaining string or cord for easy and ready use. A small bridge 131 of material is provided between groove 130 and hole 140 to fully enclose hole 140.

A handle may also be provided similar to those of the prior art cited herein, either by integrally molding the handle simultaneous with the rest of body 100, or a handle may be designed to snap into holes 140, 150 and 152. In addition, body 100 may be formed with appropriate luminescing agents so as to provide a "glow-in-the-dark" characteristic, which can be useful in a number of situations. Finally, body 100 may be formed from plastics of low enough density to allow trimmer 10 to float in water. The density may be intrinsic to the selected plastic or may alternatively be foamed or impregnated with gasses to reduce the density thereof. In another alternative embodiment, body 100 may also be manufactured from a biodegradable plastic.

In use, string, thread, fishing line, yarn or other material may be quickly pushed towards the planar surface of trimmer 10, towards blade edge 210, and pulled around trimmer 10. Due to the slightly rounded geometry of protruding ends 112, even if the line is pushed initially against one of ends 112, the line will slide off of end 112 and into direct contact with blade edge 210. Where the line is large, approaching the spacing between protruding ends 112, rounded base 114 will serve to center the line, thereby ensuring complete cutting thereof. By providing a large number of ends 112, a significant portion of blade edges 210, 212 are exposed for use, thereby ensuring longer life and more efficient use of blade 200. In the preferred embodiment, more than half of blade edges 210, 212 are available for use.

Plastic body 100 may be composed of one of the many varieties of plastic available. However, for optimal characteristics, a more durable and cut-resistant material such as nylon or ABS is preferred. By molding body 100 from a durable material, several benefits may be realized. Safety is, as aforementioned, a significant objective of the present invention. A cut-resistant plastic will help ensure that blade 200 does not cut through protruding ends 112 of guard 110. By being rigid, protruding ends 112 will also not tend to slide about, and will thereby ensure both fixed spacing between protruding ends 112 and also prevent erosion of guard 110 against blade edges 210, 212.

A more rugged material offers several additional benefits. When body 100 is both relatively rigid, non-brittle and durable, trimmer 10 may be carried freely without fear of accidental injury by being hit or broken by other objects. In other words, if a user carries trimmer 10 in hand, such as on a key ring, trimmer 10 will be open and exposed during many activities. These would include opening car and residence doors, where there is always a possibility of slipping.

Certainly, if trimmer 10 is hand carried and a person were to fall upon trimmer 10, body 100 should desirably withstand the impact and flexure forces while still continuing to shield the user from exposure to blade 200. Similarly, a user should desirably be able to carry trimmer 10 within pockets of trousers or other articles of clothing, and should not have to worry about accidentally sitting down onto trimmer 10 and worrying about breakage of body 100 or exposure to blade edges 210, 212. Even when carried in other pockets, trimmer 10 may be accidentally bumped against, and, once again, the user should not have to worry about harm or injury.

In addition, if the material of body 100 is durable and environmentally resistant to degradation, blade edges 210 and 212 will dull and corrode prior to body 100 failing. By selecting a material for body 100 having anticipated life equal to or greater than blade edges 210, 212, body 100 will allow ready disposal of trimmer 10 into regular household trash, without fear of injury to those handling garbage or compacting trash to get a little more into the container. Once in a landfill blade 200 will similarly be protected, so over the years there will be no significant environmental hazard. This is a major improvement over past disposal methods for razors, which included holes in bathroom walls through which blades were inserted. Many of these bathrooms have presented significant challenge during remodeling or demolition, due to the presence of numerous unprotected razor blades.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

What is claimed is:

1. A cutter, comprising:

a sharp, double-edged razor blade having a length, width, and thickness, said thickness being substantially less than said length or said width, said sharp double edges each extending along said length and on opposite sides of said blade;

a plastic body enveloping said razor blade and preventing manual contact therewith;

two grooves formed in said body adjacent said width of said razor blade and at opposite ends thereof;

a first hole adjacent one of said grooves but bridged therebetween by a small bridge of plastic;

a second hole extending through said razor blade and said body in a central portion of a first surface bounded by said length and said width;

a third hole extending through said razor blade and said body in a central portion of said first surface, but displaced from said second hole;

openings in said body along said length which expose said sharp double edges intermittently, through which objects may be inserted for cutting.

2. The cutter of claim 1, further comprising:

slightly rounded features in said body adjacent said openings, through which a line may be guided to said sharp double edges.

3. The cutter of claim 1, wherein said plastic is both rugged and durable.

4. The cutter of claim 3, wherein said plastic is nylon.

5. The cutter of claim 1, wherein said plastic has a life expectancy greater than said exposed sharp double edges when disposed of.

6. The cutter of claim 1, wherein said length is greater than said width, and said cutter is longitudinally symmetrical.

7. The cutter of claim 1, wherein said plastic body is luminescent.

8. The cutter of claim 1, wherein said cutter floats in water.

9. A line trimmer comprising:

a razor blade having a planar surface and a sharp edge terminating said planar surface;

a single contiguous body permanently affixed to and enveloping said razor blade;

means within said contiguous body for guiding line of indeterminate length into said sharp edge;

means within said contiguous body for preventing manual contact with said sharp edge under application of manual force, said preventing means extending from said planar surface inward of said sharp edge to beyond said sharp edge, to thereby expose said sharp edge of said razor blade and a small part of said planar surface;

means within said contiguous body for guiding and supporting line of indeterminate length, without cutting or exposure to said razor blade, during wrapping of said line about said contiguous body;

wherein said single contiguous body has a life expectancy greater than said sharp edge, whereby said sharp edge will dull and corrode prior to said body failing.

10. The line trimmer of claim 9, further comprising:

means within said contiguous body for attaching said trimmer to a key ring.

11. The line trimmer of claim 9, further comprising:

means within said contiguous body for attaching said trimmer to a key ring.

12. The line trimmer of claim 9, wherein said single contiguous body further comprises a plastic material.

13. The line trimmer of claim 12, wherein said plastic material is nylon.

14. The line trimmer of claim 9, wherein said contiguous body is luminescent.

15. The line trimmer of claim 9, wherein said trimmer floats in water.

16. A line trimmer comprising:

a razor blade having a planar surface and a sharp edge terminating said planar surface;

a single contiguous body permanently affixed to and enveloping said razor blade;

two grooves formed in said body relatively perpendicular to said sharp edge of said razor blade and at opposite ends thereof;

means within said contiguous body for guiding line of indeterminate length into said sharp edge;

means within said contiguous body for preventing manual contact with said sharp edge under application of manual force, said means extending from said planar surface inward of said sharp edge to beyond said sharp edge, to thereby expose said sharp edge of said razor blade and a small part of said planar surface;

wherein said single contiguous body has a life expectancy greater than said sharp edge, whereby said sharp edge will dull and corrode prior to said body failing.

17. The line trimmer of claim 16 further comprising a first hole adjacent one of said grooves but bridged therebetween by a small bridge of plastic.

18. The line trimmer of claim 17 further comprising a second hole extending through said razor blade and said body in a central portion of said planar surface; and a third hole extending through said razor and said body in a central portion of said planar surface, but displaced from said second hole.

19. A line trimmer comprising:

a razor blade having a planar surface, a sharp edge terminating said planar surface and a second sharp edge terminating said planar surface symmetrically opposite of a center of said planar surface;

a single contiguous body permanently affixed to and enveloping said razor blade;

means within said contiguous body for guiding line of indeterminate length into said sharp edges;

means within said contiguous body for preventing manual contact with said sharp edges under application of manual force, said preventing means extending from said planar surface inward of said sharp edges to beyond said sharp edges, to thereby expose said sharp edges of said razor blade and a small part of said planar surface;

wherein said single contiguous body has a lie expectancy greater than said sharp edge, whereby said sharp edges will dull and corrode prior to said body failing.

* * * * *